United States Patent [19]

Tremblay

[11] 3,958,738

[45] May 25, 1976

[54] STAPLE GUN FOR ACCOMMODATING A RANGE OF STAPLE SIZES

[75] Inventor: Raymond M. Tremblay, Whitman, Mass.

[73] Assignee: USM Corporation, Boston, Mass.

[22] Filed: Nov. 13, 1975

[21] Appl. No.: 631,613

Related U.S. Application Data

[63] Continuation of Ser. No. 516,105, Oct. 18, 1974, abandoned.

[52] U.S. Cl. ..... 227/109

[51] Int. Cl.[2] ..... B25C 5/06

[58] Field of Search ..... 227/109, 120, 132

[56] References Cited

UNITED STATES PATENTS

| | | | |
|---|---|---|---|
| 1,907,849 | 5/1933 | Maynard | 227/109 |
| 2,181,387 | 11/1939 | Weber | 227/109 |
| 2,445,178 | 7/1948 | Lindstrom | 227/133 |
| 2,528,444 | 10/1950 | Marano | 227/125 |
| 2,716,749 | 9/1955 | Timmerbeil | 227/109 |
| 3,282,490 | 11/1966 | Eady | 227/120 |
| 3,348,752 | 10/1967 | Wheble | 227/109 |

*Primary Examiner*—Granville Y. Custer, Jr.
*Attorney, Agent, or Firm*—Donald N. Halgren; Richard B. Megley; Vincent A. White

[57] ABSTRACT

A range of staple sizes, including different leg lengths as well as different leg spacings, is enabled to be handled by a single gun. The smallest leg spacing staples of the range are guided by a pair of spaced parallel inner rails of a magazine into driving position, the staples of greatest leg spacing straddle said rails and are guided by parallel outer walls of the magazine, and intermediate leg spacing staples are loosely guided by the inner rails and outer walls. A desirable alternative construction has these outer walls provided with centralizing leaf spring guides yieldable widthwise. No limitation on the leg lengths is imposed, and a spring-urged pusher in the magazine has its leading end provided with portions projecting inwardly widthwise thereof to insure advance of the narrowest as well as the widest staples.

5 Claims, 8 Drawing Figures

STAPLE GUN FOR ACCOMMODATING A RANGE OF STAPLE SIZES

This is a continuation of applicaton Ser. No. 516,105 filed Oct. 18, 1974, now abandoned.

BACKGROUND OF THE INVENTION

Commonly used, so-called consumer type staples are often of standard leg lengths increasing in increments of 1/16 inch from ¼ inch to about 9/16 inch, and their makers may provide them with different leg spacings as appropriate to the construction of different makes of stapling guns available on the market, each gun being capable of installing only one of the several leg spacings. It is, of course, costly and inconvenient to determine that the particular stapler one has purchased is not suited to drive staples of any leg spacing than the standard spacing for which the gun is intended and suited.

So far as known, all staplers are restricted presently to the installation of but a single leg spacing; no stapling guns of the hand-held or tacker types are currently provided which can feed and drive any of a range of differently sized wire staples. Yet with the many differently-sized staples commercially available, and the fact that often one could almost equally well employ a particular staple of somewhat different leg spacing if his tool were adapted to accept and drive all staples within a span of sizes, there exists a strong need for more versatile stapling guns.

SUMMARY OF THE INVENTION

In view of the foregoing it is an object of this invention to provide a stapling gun of simple, economical construction capable of feeding and driving a plurality of different sizes of wire staples.

More particularly it is an object of this invention to provide, in an improved hand-held stapler of the type having a magazine and pivoted magazine closure means for feeding successive side-by-side, U-shaped staples therein into position to be driven by a reciprocable driver blade, a guidance mechanism whereby the legs of the staples to be driven, regardless of their spacing within a reasonable range, will be suitably supported and delivered for the action of the driver. It will be understood that while the gun accommodates different staple sizes, the staples of any one magazine loading are preferably of only one selected size in the range.

To these ends and as herein shown, a stapling gun comprises a body formed with a magazine base and a magazine closure hinged thereto at one end, the closure having parallel guide rails extending to the other end and spaced to accommodate the smallest leg spacing of a range of sizes of staples to be accommodated side by side within the magazine base when closed by the closure, and a slider provided with side walls movable parallel and adjacent to side walls of the base and constrained for urging a series of such staples in the magazine toward that other end and into position to be driven by a driver, the slider side walls being spaced to accommodate the widest leg spacing of the staple range, and the leading ends of the slider side walls having protruding portions directed inwardly toward each other for respectively bearing on staple legs of smallest spacing and intermediately to the smallest and largest leg spacing in the range. An added feature of novelty resides in the provision of staple centralizing leaf springs respectively adjacent opposite side walls of the magazine.

BRIEF DESCRIPTION OF THE DRAWINGS

The foregoing and other features of the invention will now be more particularly described in connection with an illustrative embodiment and with reference to the accompanying drawings thereof, in which.

DESCRIPTION OF PREFERRED EMBODIMENT

Figure 2:
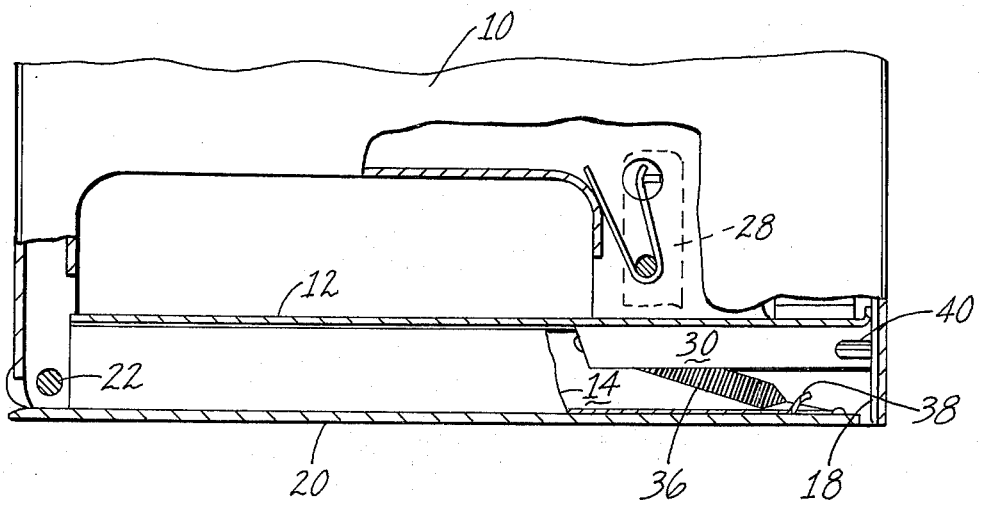
FIG. 2 is a longitudinal section showing the structure of the magazine and its closure indicated in FIG. 1.
Figure 3:
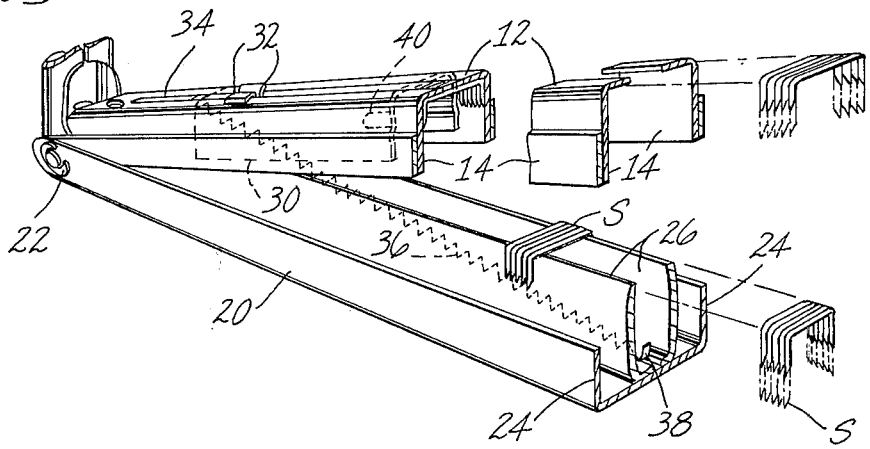
FIG. 3 is a perspective view of the magazine closure pivoted to an open position relative to the magazine base and showing a staple pusher.

In the drawings reference numeral 10 indicates the body of a stapling device, for instance a hand-held stapling gun of the type sometimes called a tacker. The body 10 is integrally formed with a U-shaped magazine base 12 extending lengthwise of the gun. This base includes downwardly extending side walls 14,14 (FIG. 2) spaced to house "sticks" of staples S (FIGS. 3–5) of different leg spacings within a range (but not simultaneously), and also the walls are of a height adequate to accommodate the longest leg lengths of staples within the range. Commercially available staples commonly have maximum leg lengths of about 9/16 inch and maximum width spacing of about 0.520 inch for non-industrial purposes, but it is to be understood that usage of this invention is not necessarily thus limited.

Figure 1:
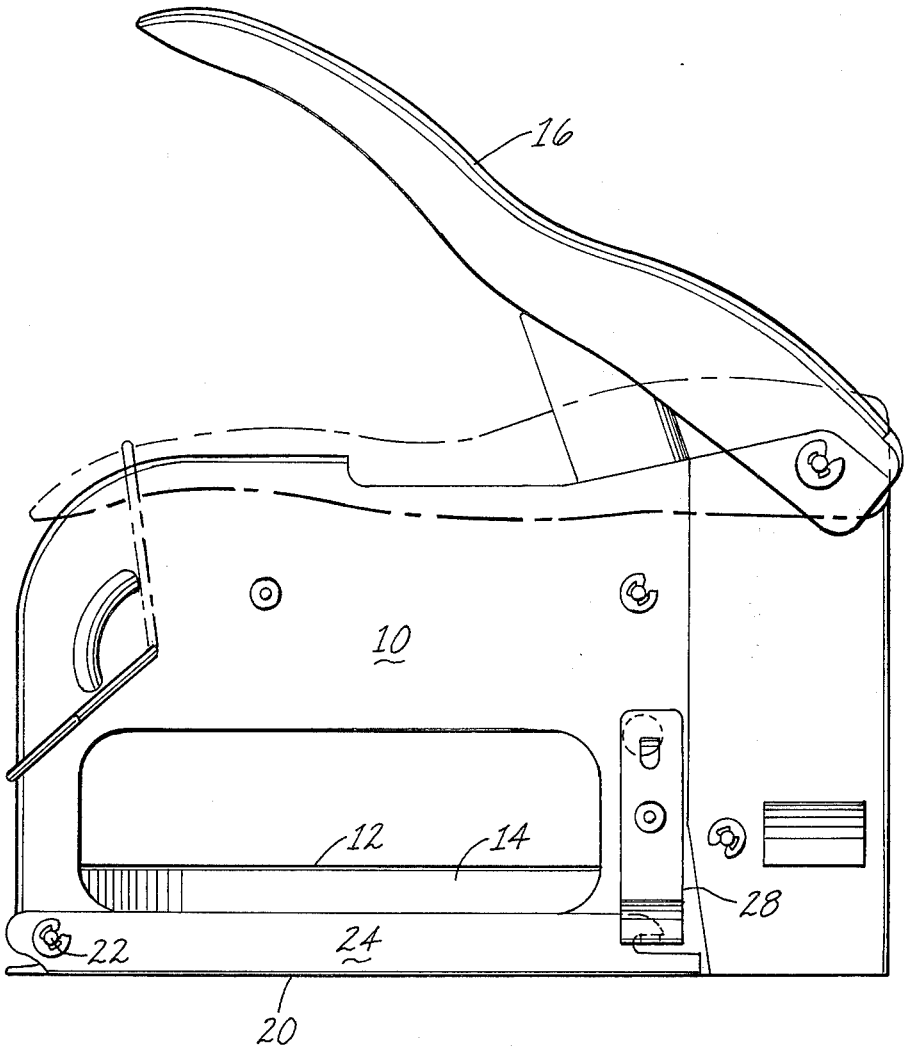
FIG. 1 is a view in side elevation of a stapler having a magazine for accommodating a range of staple sizes.

As shown in FIG. 1 an operating lever 16 is pivoted to a front upper portion of the body 10 for actuating a reciprocable blade or driver 18 (FIGS. 2, 7) through suitable mechanism which need not be described herein since it does not constitute any part of this invention. It will be understood that the driver 18 is thrust downwardly endwise against the bridge portion of each successive endmost staple S guided into the path of the driver as will hereinafter be described. The width of the driver preferably corresponds to the width of the widest staple to be driven.

Figure 5:
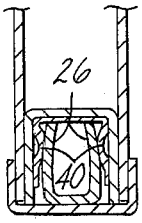
FIG. 5 is an end view of the slider in relation to closure guide rails.
Figure 6:
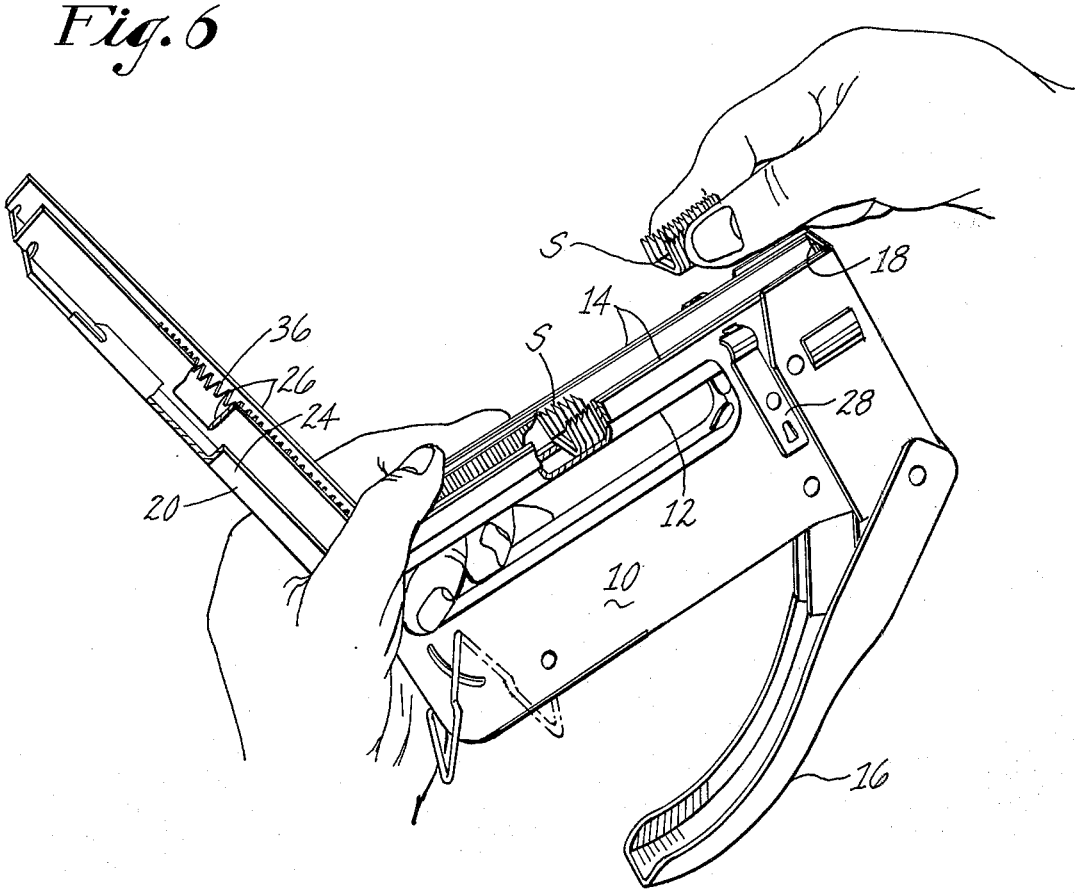
FIG. 6 is a perspective view of the stapler with magazine open and being loaded.

An elongated generally U-shaped closure 20 for the magazine base 12 is pivoted to the back end thereof by a hinge pin 22 and has side walls 24,24 spaced to embrace most of the length of the walls 14. Extending with equal spacing between the closure walls 24,24 is a pair of longitudinal staple supporting guide rails 26,26 (FIGS. 3, 5, 6) upstanding from and either integral with or secured to the bottom of the closure 20. The rails 26,26 extend forwardly of the closure bottom by the thickness of several staples and substantially up to the back or inner side of the driver 18. The rails are spaced to slidably support the smallest leg spacing of the range of sizes of the staples S to be driven. At present the minimum inside dimension between legs of staples commonly found in the so-called consumer market is 0.365 inch.

Figure 4:
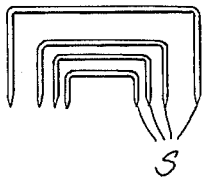
FIG. 4 is a schematic view of a range of staple sizes, i.e., different leg lengths and spacings, drivable by the stapler.

The closure 20 is releasably held in closed operating position by a latching means, for instance, levers 28,28 respectively spring urged counterclockwise to catch in recesses of the side walls 24. In loading the gun with any of the staples S selected within one leg spacing in the available size range, which is schematically illustrated in FIG. 4, they are placed over the front ends of the rails 26 and the closure 20 is latched shut. In so doing a U-shaped spring-urged slider 30 (FIGS. 2 & 3) having oppositely out-turned flanges 32,32 slidably receiving confronting edges of a longitudinal slot 34 in the base 12 is provided for engaging the loaded staples endwise and urging the foremost one forwardly into position to be driven by the driver 18. For thus urging the bridge portion of each of the successive foremost staples to become aligned with the retracted driver, a tension spring 36 (FIG. 2) is connected between the slider and a central forward lug 38 secured to the inside bottom of the closure 20.

The opposed side walls of the slider 30 are formed with inwardly projecting front portions 40,40 (FIG. 5) which extend nearly to the adjacent rails 26, respectively. Staples of least leg spacing accommodated and fed along the rails 26,26 accordingly can not pass between the advancing slide projections 40. The legs and cross bars of successive foremost staples are accordingly urged into the plane of operation of the driver 18 by the side walls and top wall or bridge of the slider 30 each time the driver is retracted in readiness for completing a driving stroke. Staples of greatest leg spacing are guided by inside walls of the magazine base, and staples of intermediate leg spacing are guided on the spaced rails 26 and are urged forwardly by the slider 30 into position to be driven.

Figure 7:
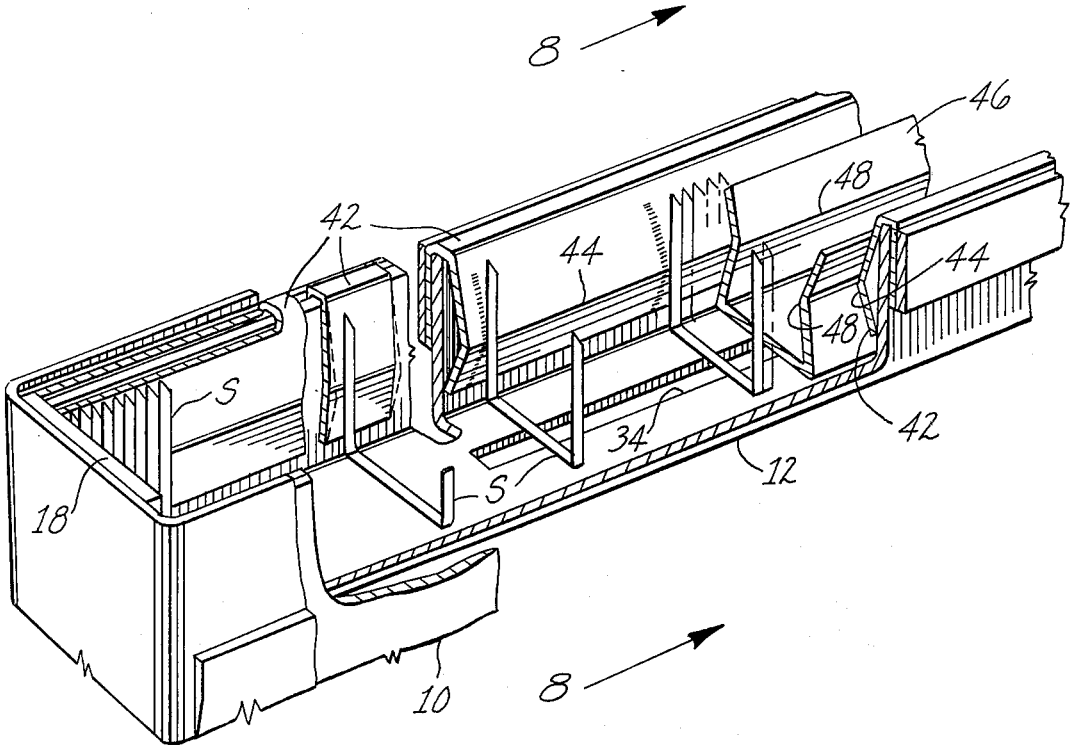
FIG. 7 is a perspective view, with portions broken away, of a modified form of the magazine and staple slider.
Figure 8:
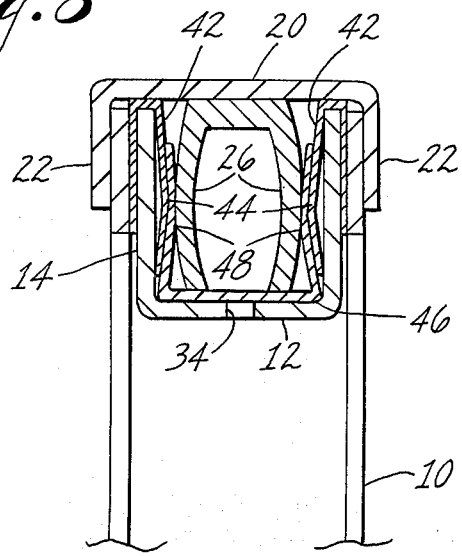
FIG. 8 is a section looking in the direction of the arrows 8-8 in FIG. 7.

A desirable further feature resides in the provision, as shown in FIGS. 7 and 8, of a staple centralizing means. To this end there is disposed at each of the opposite inner sides of the magazine base 12 a leaf spring 42. These leaf springs 42 have an inwardly bowed configuration and are adapted along their length and especially at their free forward end portions to yield apart, i.e. widthwise, whereby staples of the different leg spacings can be accommodated and centralized which is permitted by a sliding contact of the staple legs with the flexible leaf springs. As shown in FIG. 7 each spring 42 has a leg engaging vertex or projection along a line 44, and as illustrated, the wider staples S will tend to deflect and straighten the springs 42 more than staples of narrower leg spacing. The leaf springs 42 may be resiliently constructed from a material such as brass, stainless steel, plastic, or the like, which would provide only enough force on the legs of the staples to keep them centralized with respect to the magazine while not frictionally restricting their movement and preventing their sliding therethrough. Desirably, too, a slider 46 now has its opposite, relatively stiff walls formed with a contour and vertex line 48 corresponding to that of the undeflected springs 42. While the leaf springs 42 are herein shown as secured at their rearward portions by being bent over the side walls 12, it will be understood that any of several modes of securement may be employed.

From the foregoing it will be understood that this invention provides, in one stapling gun, the feeding means whereby staples of different leg spacing, and of different leg lengths, within normal commercial size range, can be conveniently driven and no mechanical adjustment therefor need be made.

Having thus described my invention what I claim as new and desire to secure as Letters Patent of the United States is:

1. A staple gun having a body provided with a magazine base portion, including:

a closure pivotable about its back end;

a mechanism for reciprocably operating a driver at the front end of said gun for acting on successive foremost staples aligned therewith;

a slider having spaced parallel walls movable in said magazine base portion for urging staples having the widest leg spacing of a range of staple sizes successively into the path of said driver to be driven thereby; and a pair of parallel staple supporting guide rails upstanding from said closure and extending toward its free end, said guide rails being spaced to accommodate the smallest leg spacing of a range of staple sizes while being equidistant from the walls of said slider, said slider also including on its forward end inwardly projecting portions extending substantially to each guide rail for providing uniform sliding pressure to any width staple encountered therewith.

2. A staple gun having a body with a magazine base portion, including;

a closure pivotable about its back end;

a mechanism for reciprocably operating a driver at the front end of said gun for acting on successive foremost staples aligned therewith;

a slider having spaced parallel walls movable in said magazine base portion for urging staples having the widest leg spacing of a range of staple sizes successively into the path of said driver to be driven thereby; and a pair of staple supporting guide rails upstanding from said closure and extending toward its free end, said guide rails being spaced to accommodate the smallest leg spacing of a range of staple sizes while being equidistant from the side walls of said slider, said gun also including staple centralizing and guiding means along said magazine base portion.

3. A staple gun as recited in claim 2, wherein said staple centralizing and guiding means is comprised of a pair of flexible leaf springs generally longitudinally mounted between the walls of said magazine base and is yieldably spreadable due to sliding contact of the legs of the respective staples with their respective leaf spring members.

4. A staple gun as recited in claim 3 wherein said leaf members are of an inwardly bowed configuration.

5. A staple gun as recited in claim 3 wherein each leaf spring is formed with a linear staple leg-engaging vertex, and the slider walls are of similar configuration.

* * * * *